United States Patent [19]

Lautenschlager

[11] Patent Number: 4,799,802

[45] Date of Patent: Jan. 24, 1989

[54] DRAWER GUIDE

[75] Inventor: Horst Lautenschlager, Reinheim, Fed. Rep. of Germany

[73] Assignee: Karl Lautenschlager GmbH & Co., KG, Reinheim, Fed. Rep. of Germany

[21] Appl. No.: 194,451

[22] Filed: May 16, 1988

[30] Foreign Application Priority Data

May 20, 1987 [DE] Fed. Rep. of Germany ..... 3716923

[51] Int. Cl.[4] ..... F16C 29/04

[52] U.S. Cl. ..... 384/19; 384/21

[58] Field of Search ..... 384/19, 18, 21, 54, 384/59, 37, 49; 312/341 R

[56] References Cited

U.S. PATENT DOCUMENTS

| | | | |
|---|---|---|---|
| 3,142,517 | 7/1964 | Ward | 384/21 |
| 4,037,885 | 7/1977 | Rock et al. | 384/19 |
| 4,511,187 | 4/1985 | Rees | 384/18 |
| 4,752,143 | 6/1988 | Lautenschläger | 384/19 |

*Primary Examiner*—Lenard A. Footland

[57] ABSTRACT

In a drawer guide having a shaped guide rail which can be fastened to the wall of a cabinet and which is engaged from below into a corresponding runner rail in the form of an inverted channel which can be fastened to the drawer, tracks for rolling bearings are formed in the interior of the runner rail. Upon a longitudinal displacement of the runner rail relative to the guide rail, these rolling bearings roll on these runner rail tracks and in tracks formed in the portion of the guide rail which is engaged in the runner rail. The portion of the guide rail that is engaged in the runner rail is bent from the substantially horizontal part of the guide rail. On the latter part of the guide rail a resiliently deformable brake element is provided and on a lateral ear of the runner rail there is provided a projection which will run against the resilient brake element in the desired braking position.

9 Claims, 2 Drawing Sheets

DRAWER GUIDE

BACKGROUND OF THE INVENTION

The invention relates to a drawer guide having a shaped guide rail which can be fastened to the carcase wall of a cabinet and which is engaged from below in a corresponding runner rail in the form of an inverted channel which can be fastened to the drawer and forms tracks within the runner rail on which rolling bearings can roll which, in the case of a longitudinal displacement of the runner rail relative to the guide rail, can roll on these runner rail tracks on the one hand and in the tracks formed in the part of the guide rail which is engaged in the runner rail on the other hand, while the portion of the cross section of the guide rail that is engaged in the bottom of the runner rail is bent up from a section that is substantially horizontally disposed.

Such drawer guides (DE-GM 81 23 213) have become increasingly popular, on account of their great carrying capacity and their easy running quality, for the mounting of drawers or other retractable attachments such as cutting boards and the like. Precisely the latter-mentioned advantage of their easy running, which permits a drawer mounted in a cabinet on such drawer guides to be pulled out or pushed in with very little effort, also has disadvantages under certain circumstances. For example, it can happen that drawers mounted in such drawer guides will spontaneously reopen after closing if the drawer guides in the cabinet have not been installed precisely horizontally but at a slight angle downward from the interior of the cabinet. On the other hand, a drawer opened all the way can close by itself if the guide rails have been installed with a tilt in the opposite direction. Even if the installation is precisely horizontal, the closing of a drawer in a chest of drawers can cause one or more adjacent drawers to open slightly when the air displaced from the back of the drawer being closed exerts an opening pressure on the back of the adjacent drawers toward the end of the closing movement. Lastly, it can also be desirable for a drawer which can be operated with a minimum of force to be slightly braked as it approaches the fully extended position or a midway, partially open position, in order to prevent a drawer which has been pulled too hard from coming to an excessively abrupt stop when it reaches the open position.

The invention is therefore addressed to the problem of designing the drawer guides here in question such that they will be gently braked and held in one or both end positions, i.e., secured against unintentional opening or closing. If it is desired or necessary, the possibility must also be created for a braking of the runner rail also in an intermediate position.

SUMMARY OF THE INVENTION

Setting out from a drawer guide of the kind described above, this problem is solved according to the invention in that, on the substantially horizontal portion of the cross section of the guide rail, alongside the runner rail, a resiliently deformable brake element is provided, and on a lateral projection of the runner rail a projection is provided which runs onto the resilient brake element in the correct braking position.

In order to be able to perform the braking action in any desired positions of the runner rail relative to the guide rail, holes are punched at equal intervals in the substantially horizontal portion of the cross section of the guide rail, lengthwise of the rails, and in them the brake element can be fastened. It is also possible, of course, to fasten a plurality of brake elements associated with different drawer positions in different holes along the length, so that, for example, a braking and holding of the drawer in both the closing and opening position will be achieved.

The brake element itself is, in a preferred embodiment of the invention, in the form of an elongated channel of plastic which is fastened with its web on the substantially horizontal portion of the cross section of the guide rail. The projection provided laterally on the runner rail will then, upon reaching the braking position, enter between the flanges of the channel and spread them slightly apart resiliently, in which case the friction developing between the flanges and the projection creates the desired braking. By making the projection oversize for the clearance between the flanges of the brake element and by selecting the stiffness of the flanges, the braking action can be adapted to given requirements.

At the same time it is recommendable for the brake element to have a greater length than the space between two adjacent openings in the substantially horizontal portion of the cross section of the guide rail, and to provide on the bottom of the web of the brake element projecting pins which can be fastened in two adjacent openings of the substantially horizontal portion of the cross section of the guide rail.

The simple and quick installation and, if necessary, removal of the brake element, and its adjustment, is then facilitated by an embodiment in which the openings punched in the substantially horizontal portion of the cross section of the guide rail are of a shape which is formed of a circular perforation and at least one slot-like prolongation running lengthwise in the rail from the circular perforation and having a width measured transversely of the rail that is smaller than the diameter of the circular perforation. The pins provided on the bottom of the web of the brake element can then be configured such that they can be fitted into the circular perforation. If one of the pins then has lateral undercuts directly adjacent the underside of the web it will be possible to shift these pins into the slot-like prolongation, so that the brake element will then be fastened on the upper side of the substantially horizontal portion of the cross section of the guide rail so as to be secure against lifting. In a preferred further improvement of the invention, the openings punched in the substantially horizontal portion of the cross section of the guide rail have a shape in which the circular perforation merges with not just one slot-like prolongation but with prolongations of lesser width running lengthwise of the rail in two opposite directions from diametrically opposite sides of the circular perforation.

The securing of the position of the brake element, obtained in the manner described above by inserting the pins into the corresponding openings and then displacing them lengthwise, is achieved by an embodiment in which one of the projecting pins has a diameter corresponding to the circular perforation, while the other projecting pin has, directly adjacent to the web surface of the brake element, a width corresponding to the slot-like prolongation or prolongations, and that the end of the second pin remote from the web surfaces has a locking flange projecting at least section-wise above an associated slot-like prolongation, whose maximum external dimensions, however, do not exceed the diameter of the circular perforations. In that case the distance between the web of the brake element and the surface of the sections of the locking flange of the second projecting pin which protrude beyond the pin should be approximately equal to the thickness of the material of the guide rail, so that a gripping of the second pin provided with the locking flange is achieved in the associated slot-like prolongation of the perforation.

The necessary securing of the brake element against displacement longitudinally of the rails is then provided by the fact that the distance between the two projecting pins of the brake element is such that the first pin, which has the diameter of the circular perforations of the mounting openings in the substantially horizontal portion of the cross section of the guide rail, when the fastening flange of the second pin is pushed through the circular perforation of an associated mounting hole, will be offset slightly in the longitudinal direction of the rail toward the circular perforation of the adjacent hole, but by a subsequent pushing of the first pin into the slot-like prolongation of the opening, can be aligned with the circular perforation in the adjacent hole. The mounting of the brake element so configured is thus performed by first pushing the locking flange of the second pin through the circular perforation of the associated opening, and the pin is then secured by displacement into the, or one of the, slot-like prolongations. The first pin, offset at first toward the circular perforation of the adjacent hole when the brake element is set, is then aligned upon displacement with the associated circular perforation, and then can be pressed into the latter. Since this pin, whose diameter intentionally corresponds to the circular perforation, cannot be displaced into the slot-like prolongation(s), the brake element is then mounted securely against lifting and against unintentional longitudinal displacement. For disassembly the procedure is reversed, by first prying the second pin out of the corresponding circular perforation and then pushing the first pin by longitudinal displacement into the range of the circular perforation of the corresponding hole, whereupon the brake element can be lifted out of the hole.

DESCRIPTION OF THE DRAWING

The invention will be explained in the following description of an embodiment in conjunction with the drawing, wherein.

DESCRIPTION OF PREFERRED EMBODIMENT

Figure 1:
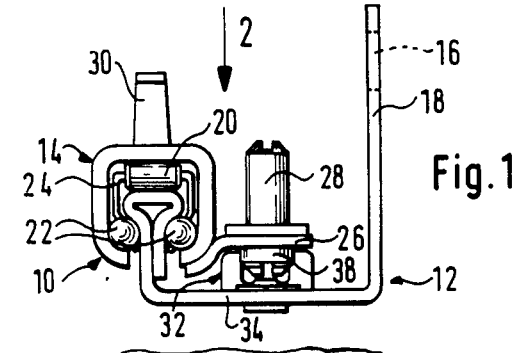
FIG. 1 is a front view of the front end of a drawer guide provided with a brake element in the manner of the invention.
Figure 2:
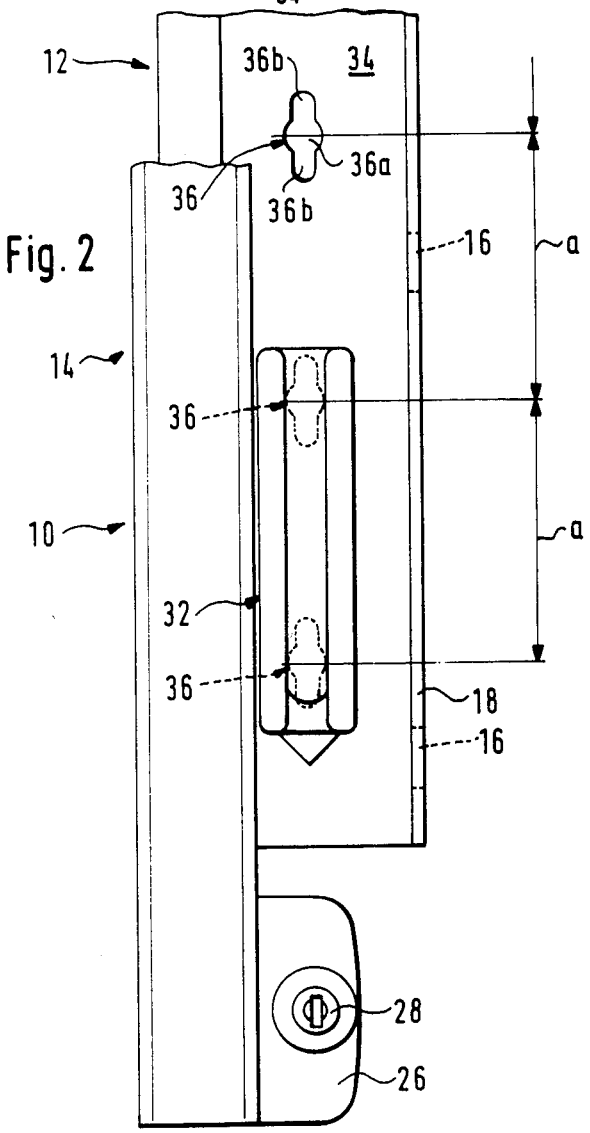
FIG. 2 is a view of the drawer guide seen in the direction of the arrow 2 in FIG. 1.

FIGS. 1 and 2 show a drawer guide of the kind involved herein, identified as a whole by the number 10. It has a guide rail 12 to be mounted on a side wall, not shown, of a cabinet carcase, and a runner rail 14 disposed for longitudinal displacement on the guide rail and designed to be fastened on a drawer, also not shown. In the case represented, the guide rail 12 is a channel formed from sheet metal, whose one flange forms a mounting flat 18 provided with holes 16 for mounting screws; this flange can be screwed to the inside of the carcase wall, while the second flange is shaped at its free end so as to have tracks running within the runner rail 14, to be described below, at a distance from the mounting flat 18, for rolling bearings in the form, in this case, of rollers 20 running on an upper track, and two rows of balls 22 running on two hollowed tracks set horizontally at a distance apart. The rollers 20 and the balls 22 are held in their mutual association and alignment by an appropriately shaped cage 24 (FIG. 1) of plastic. The rail 14 in turn is in the form of an inverted channel astride the track-bearing flange of the guide rail 12, and it is so shaped in cross section as to embrace the rollers 20 and the balls 22—in other words such that the inside surfaces of the runner rail also serve as tracks for the ball and roller bearings.

The runner rail 14 is fastened to the underside of the drawer in a known manner beside the inner face of the drawer side extending downward past the drawer bottom. It can be provided in the front end area with an ear 26 projecting into the gap between the runner rail 14 and the mounting flat 18 of the guide rail 12 and having an upwardly projecting stud 28 which can be pressed into an associated bore in the bottom edge of the drawer side. At the rear end inside the cabinet the runner rail 14 continues a short distance beyond the back of the associated drawer into the cabinet interior where it has a hanging hook 30 (FIG. 1) consisting of a section which first projects upward from the web of the runner rail 14 and then turns horizontally forward, i.e., away from the inside of the cabinet. The forwardly turned portion of the hook 30 is normally pressed into a bore in the back of the drawer.

To the extent thus far described the drawer guide 10 is known and it can be concluded that, due to the triangular arrangement of the rolling bodies in the form of rollers 20 and balls 22 displaceably mounting the runner rail 14 on the guide rail 12, drawer guides of the kind described will have, in addition to great carrying capacity and easy running, a high transverse stability even in the fully extended state, so that drawers mounted in a cabinet with a pair of such drawer guides will not have any noticeable horizontal free play even in the fully extended position.

Figure 4:
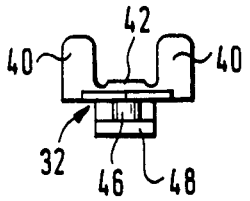
FIG. 4 is a front view of the brake element seen in the direction of the arrow 4 in FIG. 5.
Figure 3:
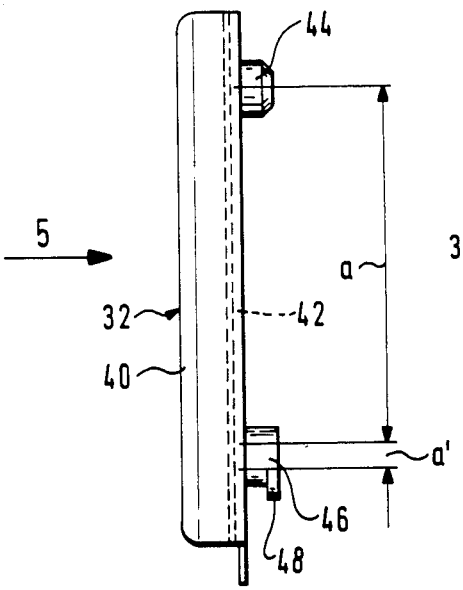
FIG. 3 is a side view of the brake element used in the drawer guide according to FIGS. 1 and 2.
Figure 5:
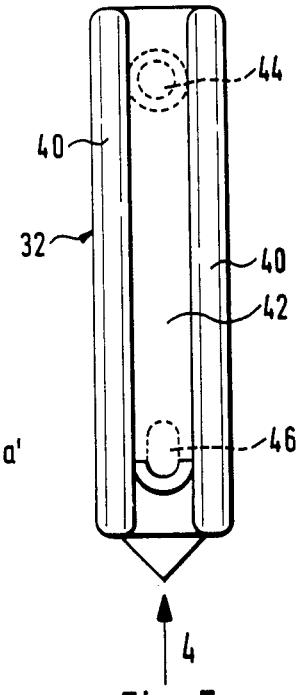
FIG. 5 is a top view of the brake element seen in the direction of arrow 5 in FIG. 3.

The substantially horizontal section 34 of the guide rail, which joins together the flanges, i.e., the mounting flat 18 and the flange engaged in the runner rail 14, serves for the mounting of the brake element 32 which is to be provided according to the invention, and which is also shown separately in FIGS. 3 to 5. For this purpose the holes 36 represented in FIG. 2 are punched at equal intervals a longitudinally into the channel web 34, and are composed each of a central circular perforation **36*a* and slot-like prolongations 36*b* adjoining this perforation longitudinally on opposite sides; their width measured transversely of the rail is smaller than the diameter of the circular perforation 36*a*. The position of the holes 36 in the web 34 in the transverse direction is selected such that they are situated centrally beneath the pin 28 fastened on the ear 26. The pin 28 in turn has on its end at the ear a threaded section screwed into a threaded sleeve 38 formed in the ear 26 and pointing downward. The threaded sleeve 38 thus forms a projection which extends downward from the ear 26 toward the web 34, and which is aligned with the center of the plane running through the holes 36 at right angles to the web 34**.

The brake element 32 is in the form of an elongated channel of plastic whose web 42 can be fastened with its bottom against the web 34 of the channel 12. For this purpose two pins 44 and 46 projecting from the bottom of the web 42 are provided, of which the one pin 44 has a diameter corresponding to the diameter of the circular perforations 36*a* in the web 34, while the second pin 46 has an elongated, rather than cylindrical, cross section, whose width corresponds approximately to the width of the slot-like prolongations 36*b* of the holes 36. This second pin 46 then has at a distance from the bottom of web 42 corresponding to the thickness of the web 34, i.e., of the material of the guide rail 12, a locking flange 48 radially projecting partially beyond its own pin 46, but one whose maximum external dimensions do not exceed the diameter of the circular perforations 36*a* of the holes 36, i.e., the locking flange 48 can be pushed through the perforation 36*a* of the corresponding mounting hole 36. If the pin 46 is then pressed into one of the adjoining slot-like prolongations 36*b*, it is secured against lifting away from the web 34 of the guide rail.

Security against longitudinal displacement such that the locking flange 48 will return into the range of the circular perforation 36*a* of the associated mounting hole 36 and the pin 46 could then be withdrawn from this hole, is provided by the first pin 44, whose distance from the second pin 46 is selected such that, when the last-named second pin 46 is pushed through the circular perforation 36*a* of the associated hole 36, it will be still offset by the dimension a' from the circular perforation of the adjacent hole 36 associated with the latter pin. Not until the pin 46 is pushed into the slot 36*b* is the pin 44 in alignment with the circular perforation 36*a* of its hole 36, and the web 42, which up to then has been resiliently bent, forces the pin 44 into the corresponding perforation 36*a*, thereby securing the brake element 32 both against lifting away and against longitudinal displacement. The removal of the brake element therefore requires first that it be pried out such that the pin 44 comes out of the circular perforation 36*a*, the web surface 42 being again flexed. With the web 42 in this flexed state, the brake element as a whole must then be pushed in the longitudinal direction such that the locking flange will be brought back into the range of the circular perforation 36*a* of the associated hole 32. Then the second pin 46 can also be drawn out of the associated hole 36.

In the embodiment described above, the arrangement of the brake element 32 on the web 34 of the guide rail 12 is made such that it cooperates with the projection formed by the threaded sleeve 38 to hold the pin 28, i.e., the brake element brings about a gentle braking of a drawer upon reaching the closed state as well as security against unintended, spontaneous reopening of the closed drawer—say, as a result of the earlier described imprecise horizontal mounting of the guide rail 12 on the cabinet or due to the action of the air displaced by an adjacent drawer when it is closed. It is clear that, by an offset mounting of the brake element 32 on the web 34 and providing a correspondingly offset projection on the runner rail 14 the braking action can also be achieved in the fully open position of the drawer. Brake elements can also be disposed between the two end positions in order to brake and hold a drawer in the half-open position, for example, since mounting holes 36 are provided, as described, over the entire length of the guide rail. On the other hand, such an arrangement of holes 36 over the entire length of the guide rail is not essential, and it can be sufficient to provide two holes 36 at the distance a apart at the location or locations of the web 34, to correspond to a specific braking action to be provided.

It is furthermore to be noted that the brake element 32 can also have a form different from the special configuration described. Instead of the channel-shaped plastic brake element, a resilient body cooperating with the free face of a projection disposed laterally of the runner rail and joined to the runner rail can be provided, which is fastened on the web 34 of the guide rail in the manner described or in some other manner.

A previously not mentioned important advantage of the longitudinally displaceable arrangement of the brake element 32 on the web 34 of the guide rail also lies in the fact that this makes it possible to use the drawer guide without changing the dimensions of the guide rail 12 and of the runner rail 14 on drawers of different length in the direction of drawer movement. The drawer of smallest length in this case is of about the length of the longer of the two rails of corresponding drawer length, while in the case of drawers of greater length the two rails are set further back. In the case of different drawer lengths, however, the position of the mounting place at which the brake element is to act changes if it is intended as a holding brake for the closed drawer. The possibility of mounting the brake element in a different place by plugging it into different holes 36 makes it possible, however, to mount the brake element 32 so as to be offset as required, in which case odd drawer lengths are thus easily acceptable because the brake element itself spans the distance a and the braking action on the associated projection of the runner rail will be provided at any position of the projection within the brake element.

I claim:

1. A drawer guide comprising: a shaped guide rail to be fastened to a carcase wall of a cabinet, a runner rail in the form of an inverted channel to be fastened to a drawer of the cabinet and engaged from below by the guide rail, tracks defined between the two rails, roller bearings rolling on said tracks in case of a longitudinal displacement of the runner rail relative to the guide rail, said guide rail having a substantially horizontally disposed web laterally beside the runner rail, a resiliently deformable brake element on said web, said runner rail having a lateral extension, and a projection on said extension and adapted to run onto the braking element to brake the runner rail.

2. A drawer guide according to claim 1, wherein spaced holes are provided in said web at uniform intervals, in which the brake element is fastenable.

3. A drawer guide according to claim 2, wherein the brake element is an elongated plastic piece of U-shaped cross section having a bottom portion resting on the web.

4. A drawer guide according to claim 3, wherein the brake element has a slightly greater length than the distance between two adjacent holes in the web, and two projecting pins on the underside of the bottom portion and fastened in two adjacent ones of said holes.

5. A drawer guide according to claim 3, wherein each hole includes a circular perforation and, running lengthwise of the guide rail from the circular perforation, at least one slot-like extension with a width measured transversely of the guide rail smaller than the diameter of the circular perforation.

6. A drawer guide according to claim 5, wherein each hole has at diametrically opposite sides a slot-like extension each, of lesser width than the circular perforation.

7. A drawer guide according to claim 6, wherein one of the projecting pins has a diameter corresponding to the diameter of the circular perforation, while the other projecting pin has a width corresponding to that of the slot-like extension, said other pin having at an end remote from the bottom portion a locking flange which projects at least partly beyond an associated slot-like extension but whose maximum external dimensions do not exceed the diameter of the circular perforation.

8. A drawer guide according to claim 7, wherein the bottom portion is spaced from the locking flange by a distance approximately equal to the thickness of the web.

9. A drawer guide according to claim 7, wherein said two projecting pins are spaced from each other such that, when the locking flange of said other pin is put through the circular perforation of one of said holes, said one pin is slightly displaced lengthwise of the guide rail with respect to the circular perforation of an adjacent hole, but that upon a subsequent pushing of said one pin into the slot-like extension of said adjacent hole said one pin may be aligned with the circular perforation of the adjacent hole.

* * * * *